United States Patent [19]

Hutwohl

[11] Patent Number: 4,909,052

[45] Date of Patent: Mar. 20, 1990

[54] DOOR SAFE FOR DELIVERY AND PICK-UP OF ARTICLES

[76] Inventor: Kenneth W. Hutwohl, P.O.Box 304, Danbury, Conn. 06810

[21] Appl. No.: 367,956

[22] Filed: Jun. 16, 1989

Related U.S. Application Data

[63] Continuation-in-part of Ser. No. 237,831, Aug. 29, 1988, abandoned.

[51] Int. Cl.[4] ..... E05B 65/52

[52] U.S. Cl. ..... 70/63; 109/50

[58] Field of Search ..... 70/57, 58, 63; 248/551, 248/552, 553; 109/13, 45, 49, 50, 51, 52, 68; 211/4, 5, 6, 7, 8

[56] References Cited

U.S. PATENT DOCUMENTS

| | | | |
|---|---|---|---|
| 3,146,739 | 9/1964 | Furman | 109/52 |
| 3,742,741 | 7/1973 | Cahan | 70/63 |
| 3,744,281 | 7/1973 | Logue | 70/63 |
| 3,927,792 | 12/1975 | Andrade | 109/52 |
| 3,934,434 | 1/1976 | Law | 70/63 |
| 4,112,717 | 9/1978 | Bradley | 70/63 |
| 4,244,304 | 1/1981 | Read | 109/52 |
| 4,463,584 | 8/1984 | De Forrest | 70/63 |
| 4,694,668 | 9/1987 | Ciletti et al. | 70/63 |
| 4,821,538 | 4/1989 | Gray | 70/63 |

*Primary Examiner*—Robert L. Wolfe

*Attorney, Agent, or Firm*—Mattern, Ware, Stoltz & Fressola

[57] ABSTRACT

A secure box or safe having a mounting plate with a channel-shaped flange at the top thereof such that the safe may be hung from the top edge of an outer door of a residence and, when the door is closed, the safe is captured in place between the top of the door, the door head, the outside surface of the door, and the door stop. The safe may alternatively be located on another edge of the door. Acess to the safe by a delivery person is by unlocking the safe housing and removing it from the mounting plate. Loading or unloading of the safe by the occupants of the residence is accomplished through a loading portal on the inside wall of the safe, which loading portal is inaccessible when the door is closed, as the inside surface of the safe is held tightly adjacent the outside surface of the door. The safe is relatively weatherproof.

10 Claims, 3 Drawing Sheets

FIG. 1
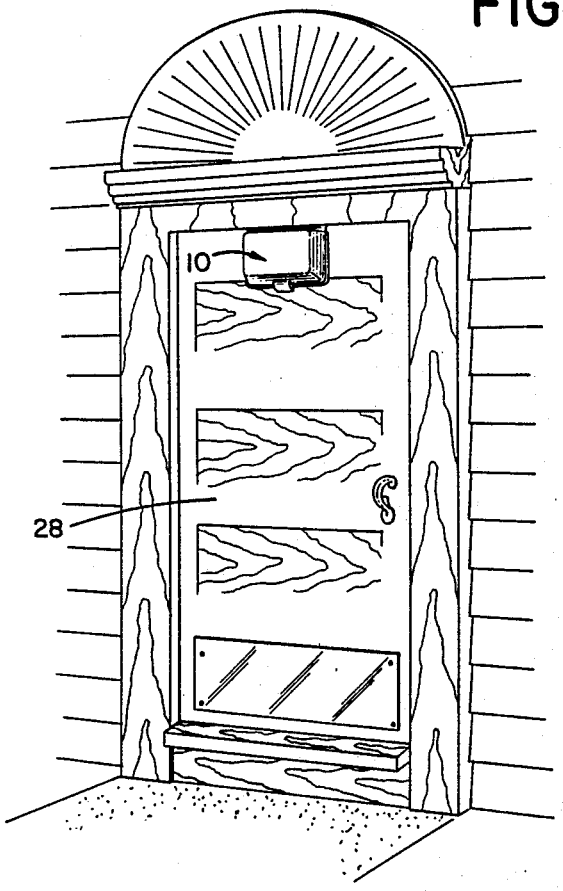
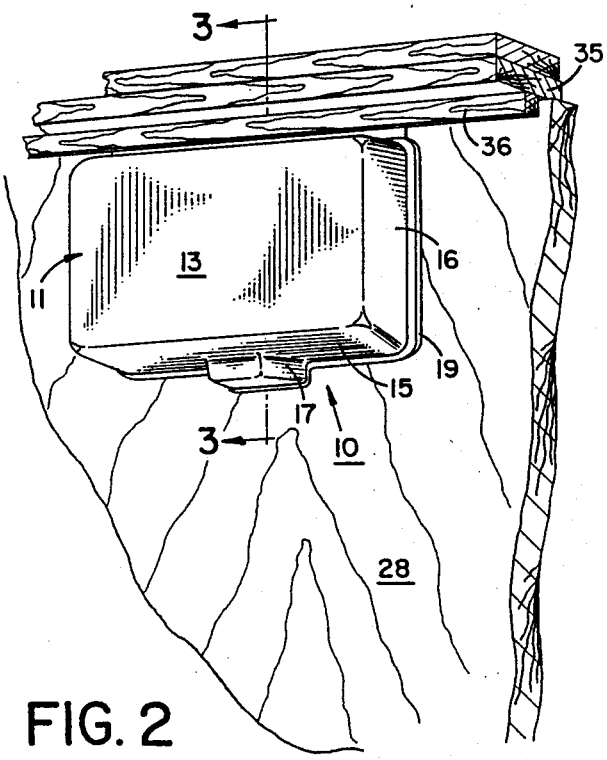
FIG. 2
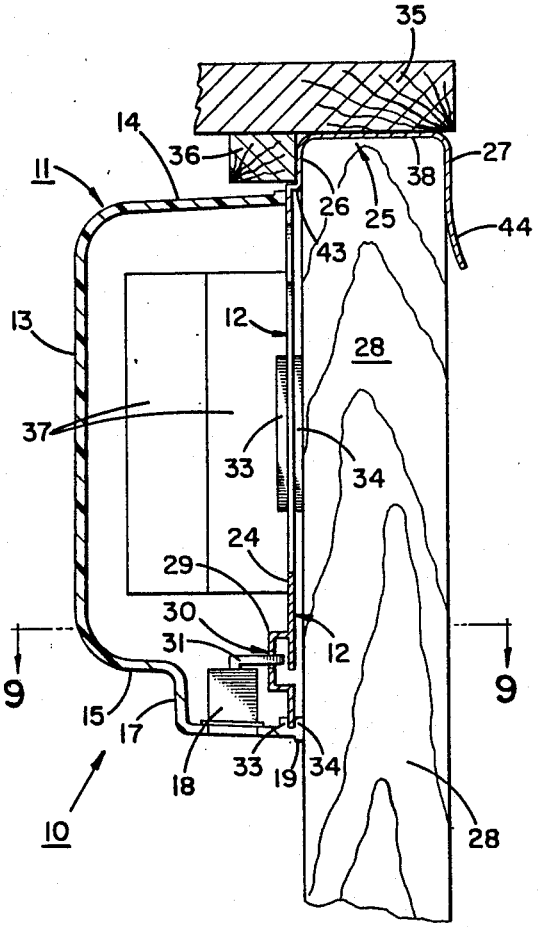
FIG. 3

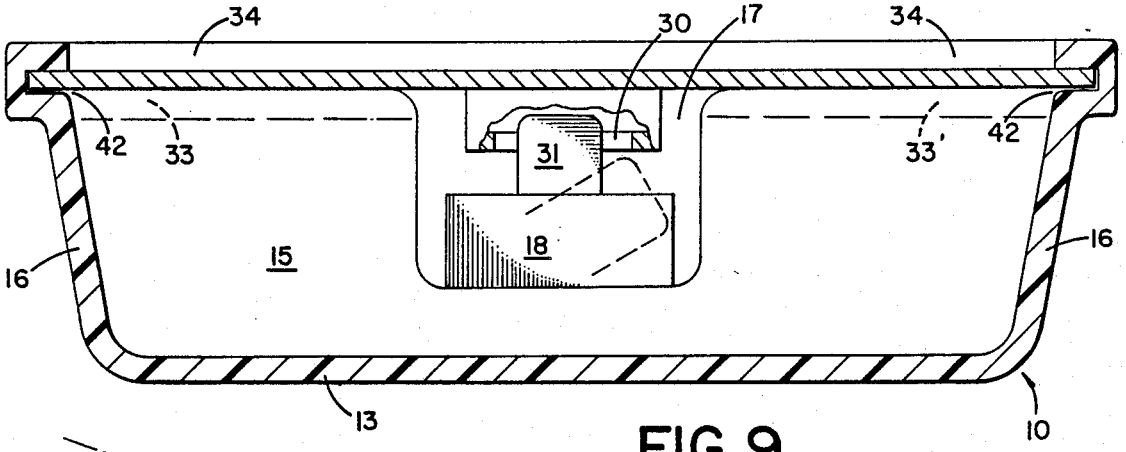
FIG. 9
FIG. 8
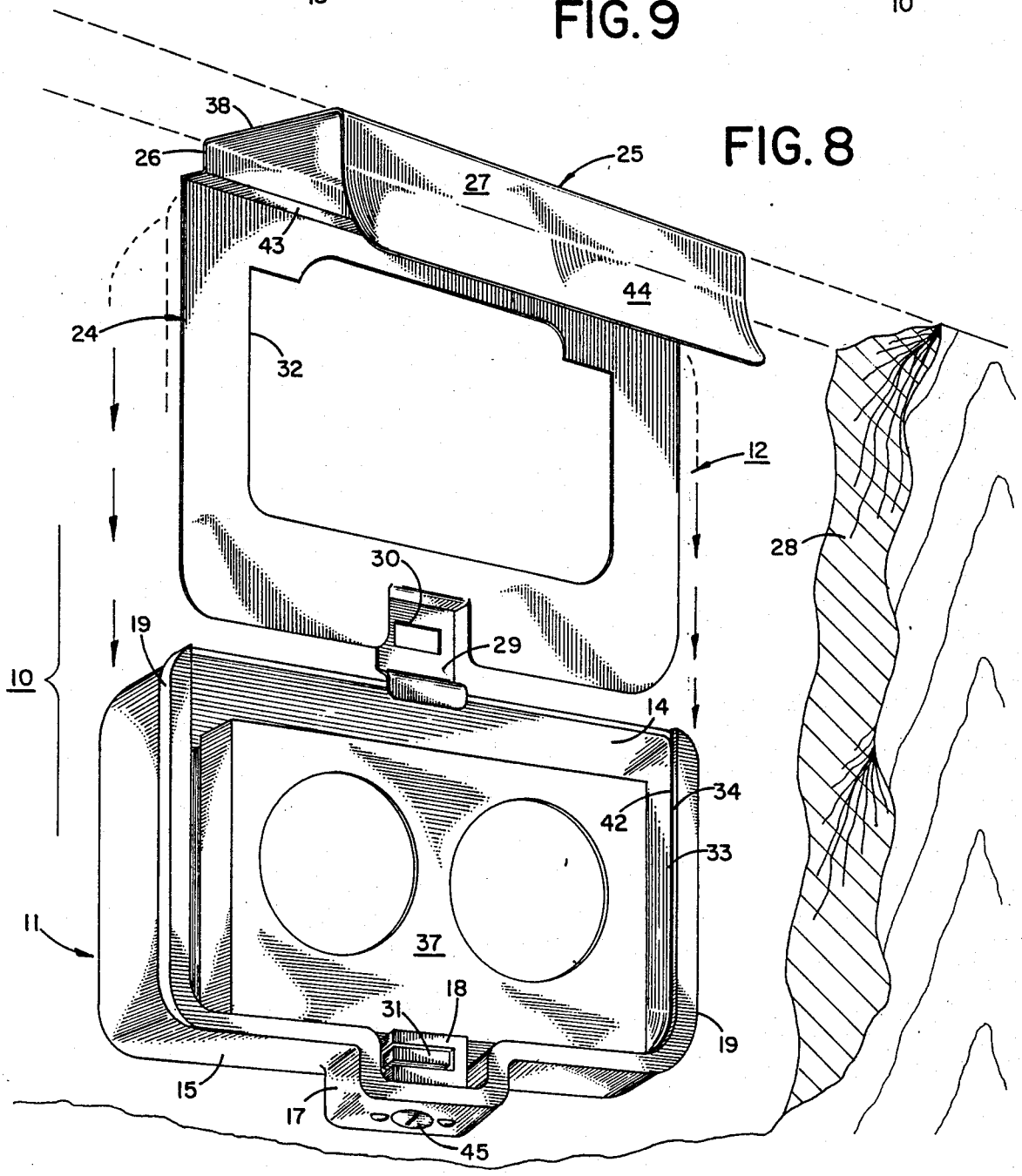

DOOR SAFE FOR DELIVERY AND PICK-UP OF ARTICLES

CROSS REFERENCE TO RELATED APPLICATION

This is a continuation-in-part of my co-pending U.S. patent application Ser. No. 07/237,831, filed Aug. 29, 1988 and now abandoned.

FIELD OF THE INVENTION

The present invention relates to door safes in general, and more particularly to a door safe for secure temporary mounting on the front door of a home and especially adapted for use in the delivery and pick-up of articles such as videotapes while the residents are not at home.

DESCRIPTION OF THE RELATED ART

While the present invention is described as being useful in the delivery and pick-up of videotapes, it will be understood by those skilled in the art that embodiments thereof may be used as well in the delivery and/or pick-up of other articles.

In times past, the delivery and/or pick-up goods at private residences was much more common that it is today. Laundry, dry cleaning, ice, milk, and bread, for example, were routinely delivered to many, if not most, residences. Today, however, such deliveries are much less common, due, in part, to high labor costs. At least as important as labor costs, moreover, is the fact that there is no one present in a majority of residences during the day, either because a greater number of people are working outside the home or because of outside activities. In any case, there is no one present to receive relatively valuable goods that cannot safely be left on a door-step in most neighborhoods. A present day example of such goods are videotape cassettes which have become popular short-term rental items, sometimes on an almost daily basis by some viewers. A major problem with the delivery of videotape cassettes, however, is that they do fall into the category of relatively expensive goods which cannot simply be left at a temporarily unoccupied residence.

In U.S. Pat. No. 4,694,668, issued Sept. 22, 1987, to Ciletti et al, there is described a security box for articles such as videotape cassettes which is intended to be mounted over the edge of an outer residence door by means of a bracket which fits around the door edge. Access to the interior of the box by a delivery person is effected by means of opening a locked, hinged, outer panel which uncovers an outer access opening. Access to the interior of the box by a recipient is effected by opening the door, lifting the box off the door edge and opening an unlocked, hinged, inner panel which uncovers an inner access opening. When the box is mounted on the door, the inner panel is held closely adjacent the surface of the residence door and thus the contents of the box are not easily accessible without a key. The box is positioned such that, should one attempt to pry the box away from the door, the distance it can be pried is limited because the box will soon engage the doorframe and prohibit further movement.

While the above-described security box is satisfactory in some respects, it has two major disadvantages: First, the front panel represents a point of weakness, as it may be removed from the mounted box by inserting a prying tool between the edge of the front panel and the edge of the box or by breaking or prying off the hinge. Second, because of the location of the front panel, it does not afford very complete weather-tightness, as wind-driven rain could fairly easily seep through the outer access opening and soak the contents of the box, unless the panel were gasketed—a relatively expensive, and not long-lasting, measure. Also, water running down the surface of the door can easily enter the box through the inner access opening.

SUMMARY OF THE INVENTION

The present invention solves the problem of delivery and pick-up of relatively expensive goods, such as videotapes, by providing a secure box, or safe, securely but removably attached to an outside residence door, which box or safe is accessible by both a delivery person and the residents.

Briefly, according to the invention in a preferred embodiment, there is provided a secure box or safe having a unitary concave hollow housing slidably engaged with and lockably anchored to a mounting plate with a channel-shaped flange at the top thereof. The flange may be hung from the top edge of an outer door of a residence securely mounting the safe against the outer surface of the door and, when the door is closed, the safe is captured in place between the top of the door, the lintel or door head, the outside surface of the door, and the door stop. The safe may alternatively be located on another edge of the door. Access to the safe by a delivery person is by unlocking the safe housing and removing it slidingly from the mounting plate. Loading or unloading of the safe by the occupants of the residence is accomplished through a loading portal on the inside wall of the safe, which loading portal is exposed when the door safe is removed from the door, but is inaccessible when the door is closed, as the inside portal surface of the safe is held tightly adjacent the outside surface of the door. Being formed of sturdy rigid material, the safe is relatively weather proof.

Accordingly, a principal object of the invention is to provide a door safe removably mounted on an exterior door for the delivery and pick-up of relatively expensive goods such as videotapes.

Another object of the invention is to provide such a safe that is easily removable from the opened door, but which is relatively tamperproof when the door is closed.

An additional object of the invention is to provide such a safe that is relatively weatherproof.

Other objects of the invention will in part be obvious and will in part appear hereinafter.

The invention accordingly comprises the features of construction, combination of elements, and arrangements of parts which will be exemplified in the constructions hereinafter set forth, and the scope of the invention will be indicated in the claims.

For a fuller understanding of the nature of an objects of the invention, reference should be had to the following detailed description taken in connection with the accompanying drawings, in which:

BRIEF DESCRIPTION OF THE DRAWINGS

FIG. 1 is a perspective view of a residence front door on which is securely mounted an assembled and locked door safe constructed according to the present invention;

FIG. 2 is a fragmentary enlarged front perspective view of the door safe mounted on the residence front door, closely juxtaposed to the overlying lintel.

FIG. 3 is a cross-sectional side elevation view taken along the plane 3—3 in FIG. 2, showing the door safe mounted on the top edge of a door, which is shown closed against its door stop under its lintel, clamping the door safe firmly and securely in its mounted position;

FIG. 8 is an exploded rear perspective view of the door safe components after sliding dis-assembly; and, FIG. 9 is a top plan cross-sectional view taken along the plane 9—9 shown in FIGS. 3 and 7 and partially broken away, showing the locking mechanism in both its locked and its unlocked positions.

DETAILED DESCRIPTION OF THE PREFERRED EMBODIMENTS

Figure 4:
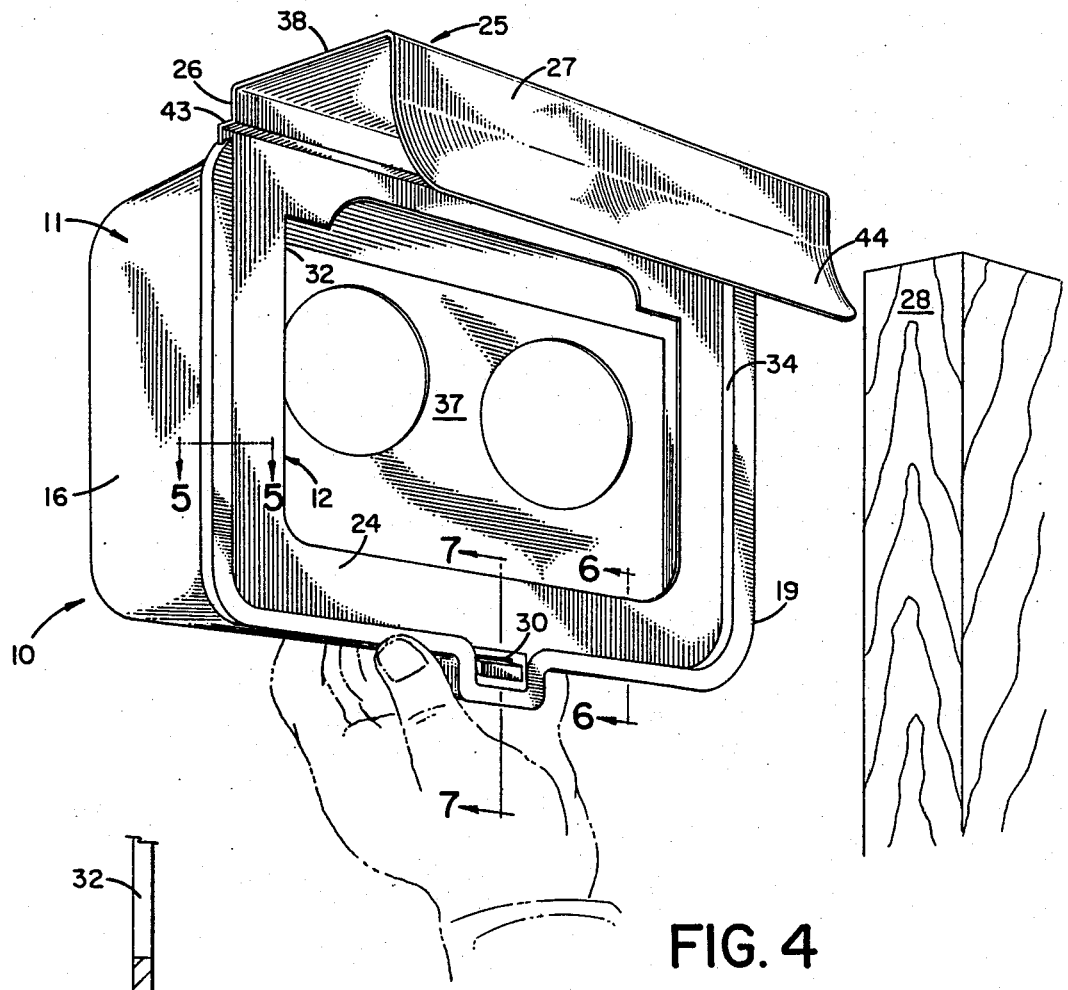
FIG. 4 is a rear perspective view of the assembled and loaded door safe, shown in the process of being installed on the upper edge of an outer residence door.
Figure 5:
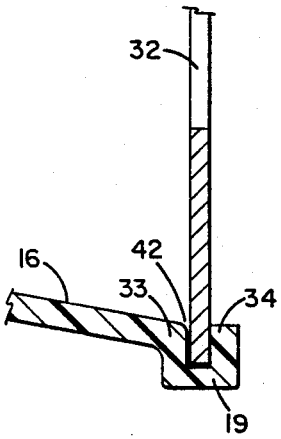
FIGS. 5, 6 and 7 are enlarged cross-sectional detail views showing the gripping flange means by which the housing and the mounting plate are held together when the door safe is in its closed position, FIG. 7 showing the lock mechanism releasably anchoring the concave housing to the mounting plate.
Figure 7:
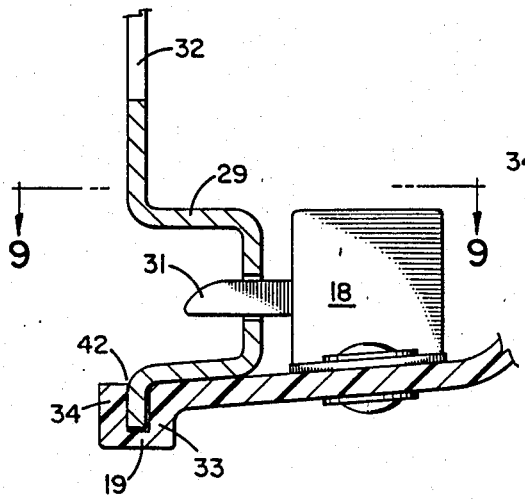
Figure 6:
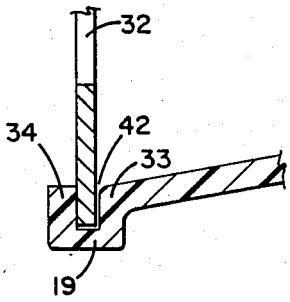

Referring now to the drawings, FIGS. 1 through 9 show a door safe according to the present invention, generally indicated by the reference numeral 10, in which identifying numerals of the various elements of the door safe are consistent throughout the various figures.

Safe 10 is of generally rectilinear shape and includes a unitary, hollow, box-like housing, generally indicated by the reference numeral 11 (FIGS. 1–4), and a mounting plate having an inverted L shape in cross section, generally indicated by the reference numeral 12 (FIG. 8). Housing 11 includes a face 13 and a top wall 14, a bottom wall 15, and two side walls 16, the walls extending generally perpendicularly from the face and being joined so as to form an open box-like housing. Bottom wall 15 has formed therein a downwardly extending lock housing 17 in which is mounted a lock mechanism 18. Formed around the periphery of walls 14, 15, 16 is a reinforcing rim 19.

Being shaped in cross-section like an inverted L or a capital Greek letter Gamma, the mounting plate 12 includes as its longer vertical leg a base plate 24. Extending horizontally from the top end of the base plate is a downward facing channel-shaped flange 25, the shorter leg of plate 12, shaped for embracing engagement with edge of a residence door.

Rim 19 of housing 11 is provided with an inward facing groove 42 on the lower edge and both side edges, providing sliding engagement with the rim of base plate 24 of mounting plate 12 from the disengaged position of FIG. 8 to the engaged position of FIG. 4 with mounting plate 12 spanning the open side of housing 11.

As shown in FIGS. 1, 2 and 3, this assembled door safe 10 is deployed on the outer face of an exterior residence door 28 with its hollow unitary housing 11 facing convexly outward and firmly anchored against door 28, protecting the contents from tampering, weather or unauthorized removal. This anchored deployment is assured by the shape of mounting plate 12 and its sturdy engagement with housing 11.

Flange 25 has a first side 26 thereof formed as an extension of the base plate 24, with a downturned rim forming a second side 27 thereof spaced apart from the first side and joined thereto by a web or bridging panel 38, the width of which is approximately the thickness of the standard exterior door 28 upon which the safe is to be mounted (FIG. 3), customarily $1\frac{3}{4}$ inches, so that the flange 25 will fit closely around and embrace the top or an edge of the door. Second side 27 of flange 25 may have a slight outward bent or curve 44 at the lower end thereof, as shown, to guide and facilitate the placement of safe 10 on door 28.

Formed centrally at the lower edge of base 24 is an offset U-shaped lock tab 29 (FIGS. 7, 8) in which is defined a slot 30. Into slot 30 may closely fit a tang 31 of the lock mechanism 18 when safe 10 is in its closed position (FIGS. 3, 4, 7 and 9).

Base plate 24 also includes a loading portal 32 for access to the interior of safe 10 when the safe is demounted from door 28. In the preferred embodiment shown in the drawings, the portal 32 is dimensioned to allow standard VHS videotape cassettes to be loaded therethrough.

To ensure that housing 11 is securely fixed to mounting plate 12 when safe 10 is in its closed position, there are provided a pair of inner and outer gripping flanges 33 and 34 formed on all or at least a portion of the rim edge 19 of bottom wall 15 and both side walls 16 (FIGS. 3–9), forming between themselves the mounting plate-engaging groove 42. When housing 11 and mounting plate 12 are assembled by sliding them into interfitting engagement, as shown by arrows in FIG. 8, to bring safe 10 into its assembled and closed condition, the lower edge and both side edges of base plate 24 is closely embraced in slot 42 between inner and outer gripping flanges 33 and 34, respectively, the outer gripping flange being an inward extension of rim 19 toward loading portal 32.

As shown in FIGS. 3, 4 and 8, channel flange 25 is joined to base plate 24 by a narrow horizontal shoulder step 43 having a width corresponding to that of outer flange 34. First side 26 of channel flange 25 extends upward a distance matching or slightly exceeding the thickness of the door stop 36, customarily $\frac{3}{8}$ inch, for standard exterior residence doors opening inward.

The step configuration formed by these two unitary segments, shoulder step 43 and first side 26 joining the unitary base plate 24 to channel flange 25 serve to position the assembled door safe 10 with its housing 11 closely underlying the adjacent door jamb or lintel 35 and held firmly against the outer face of door 28. Mounting plate 12 is preferably formed of stiff, rigid sheet metal. It can be stamped or bent with its segments 24-43-26-38-27-44 (FIGS. 3, 4 and 8) successively joined at bend lines, but it is not easily deformed by hand or with small hand tools.

It can be seen in FIG. 3 that, when the assembled safe 10 is mounted on top of door 28 and the door is closed, the safe is secured in place by virtue of the door engaging face of base plate 24 and the rim 19 of housing 11 being anchored firmly adjacent the outside surface of the door 28, flange 25 (26-38-27) being closely fitted embracing the top of the door and under the adjacent door head or lintel 35, and first side 26 of flange 25 being adjacent door stop 36.

Thus, when door safe 10 is locked, with lock tang 31 engaged in slot 30, retaining housing 11 engaged with and locked to base plate 24, and when the supporting door 28 is closed and locked, the content 37 of the door safe, such as VCR cassettes or boxed videotapes, are relatively secure against theft.

With the edge of base plate 24 of mounting plate 12 closely held in groove 42 by gripping flanges 33–34, and by lock tang 31 engaged in slot 30, and with reinforcing rim 19 and outer gripping flange 34 being held firmly against the outside surface of the door, by rigid flange 26-38-27 embracing the top of door 28, door safe 10 is also relatively secure against being forced open with a crowbar or the like. It will be understood that safe 10 could also be mounted on the side of the door, in which case element 35 would be a side jamb rather than a door head. Safe 10 may also be mounted at the base of door 28 if desired, although such could be less convenient to the user.

For a description of the use of safe 10, it may be assumed that the occupant of the residence has placed an order for goods, such as videotapes. Before leaving the residence, the occupant places locked safe 10 on door 28, by embracingly engaging the top edge of door 28 with flange 26-38-27 (FIG. 4), and then closes and locks the door in the position shown in FIGS. 1–3.

Later, the delivery person, who need be the only person having a key, inserts a key (not shown) in lock mechanism 18, rotates tang 31 out of engagement with slot 30, and slides housing 11 downward from mounting plate 12, to the disengaged position shown in FIG. 8, leaving the mounting base plate 24 in position on the door. The delivery person then places goods 37 inside safe 10, with any accompanying papers (bills, order forms, etc.), slides housing 11 onto base plate 24 and locks the housing back in place, again in the position shown in FIGS. 1–3. Since only the delivery person requires a key, the risk of theft of keys or loss of keys by customers is totally eliminated.

Sometime later, the occupant unlocks and opens door 28, lifts safe 10 off the door and removes the goods through loading portal 32 without having to unlock the door safe. If and when the goods are to be picked up, the occupant places them (and any papers) in door safe 10 and mounts the door safe on door 28 which is then locked, again as shown in FIGS. 1–3. The delivery person can then again remove the goods and, if requested, leave others by following the above procedure.

The construction of safe 10 inherently renders it relatively tamperproof and weatherproof. Reinforcing rim 19 of housing 11 fits snugly against door 28 and there are no openings in face 13 or walls 14, 15 or 16, except for the bottom keyhole opening 45 formed in lock housing 17 (FIG. 8) for key access to the lock mechanism, and the box is preferably positioned so that opening faces downward. In the preferred embodiment shown, base plate 24 of mounting plate 12 is spaced apart from door 28 by outer gripping flanges 34, so any water running down the door would not enter loading portal 32. Even greater weatherproofing can be effected, if desired, by having gripping flanges 33 and 34 formed along the entire length of bottom wall 15 and side walls 16. Box 10 is mounted so that top wall 14, which necessarily can have no gripping flanges, is adjacent the door head or side jamb, so that ingress of water past reinforcing rim 19 of the top wall is highly unlikely.

It can be seen that safe 10 is simply constructed, housing 11 preferably being of sturdy stamped metal or of a strong, preferably reinforced, polymeric material, while mounting plate 12 is preferably of rigid metal construction. When constructed of metal, the elements of safe 10 may be bent or stamped from sheet stock and welded where necessary during manufacture. When constructed of polymeric material, housing 11 may be molded or otherwise formed by techniques known in the art. Lock mechanism 18 may be of any suitable type known in the art.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A door safe to enclose selected articles, comprising:

a mounting plate;

said mounting plate including means to removably mount said mounting plate on a door, comprising a channel-shaped flange which fits closely around an edge of said door;

a housing, to contain said selected articles, lockably mountable on said mounting plate;

said mounting plate having defined therein a loading portal, so that said selected articles can be placed in said housing or removed therefrom through said loading portal when said housing is mounted on said mounting plate and said door safe is demounted from said door; and when said mounting plate is mounted to said door, said housing is mounted to said mounting plate, and said door is closed, said door safe cannot be removed from said door, said loading portal is held closely adjacent the surface of said door, and the interior of said housing is accessible only by removing said housing from said mounting plate.

2. The door safe defined in claim 1, wherein, when said mounting plate is mounted with said channel-shaped flange engaging an edge of said door and said door is closed, said channel-shaped flange is captured between said door edge and a surface of the doorframe of said door and the door stop of said doorframe.

3. The door safe defined in claim 1, wherein said housing further comprises:

a face plate; and a top wall, a bottom wall, and two side walls extending perpendicularly out from said face plate and joined so as to form a generally rectilinear box-like structure.

4. The door safe defined in claim 1, wherein said mounting plate includes a base plate which forms the back of said safe and to which said housing is attached when said housing is mounted on said mounting plate.

5. The door safe defined in claim 4, wherein said base plate is spaced apart from the outer surface of said door when said safe is mounted on said door.

6. The door safe defined in claim 4, wherein said housing is attached to said mounting plate by means of gripping flanges formed on said housing.

7. The door safe defined in claim 4, wherein said base plate includes a loading portal defined therein for access to the interior of said safe when said housing is mounted on said mounting plate and said safe is demounted from said door.

8. The door safe defined in claim 3, wherein said top, bottom, and side walls have a reinforcing rim formed around the peripheries thereof.

9. A hollow door safe adapted to be removably deployed on the outside face of an exterior door and capable of being locked to enclose valuable contents therein and being unlocked to remove contents therefrom or insert contents therein without opening the exterior door, comprising a rigid mounting plate having a substantially vertical face plate of substantially rectangular shape with a lower edge, two side edges and an upper edge, and a door edge-engaging channel flange extending from the upper edge, a hollow substantially rectilinear integral boxlike housing having a rectangular face panel, a top wall panel, two side wall panels and a bottom wall panel, with the walls being integrally joined along a first edge thereof to the rectangular face panel to form a hollow enclosure, with a second edge of each said wall panel integrally joined to a third edge of the next adjacent wall panel, and with a fourth free edge of each wall panel opposite said first edge being formed as a reinforcing rim, the interior portions of the reinforcing rim of the bottom wall panel and both side panels being formed as inwardly extending parallel inner flange means and outer flange means spaced apart by a distance exceeding the thickness of the face plate and thereby defining between themselves a groove slidably receiving the bottom and side edges of the face plate therein, and unlockable locking means positioned when locked to retain the face plate in slidable engagement in the groove, and when unlocked to release the housing for sliding disengagement of the face plate from the groove.

10. The hollow door safe defined in claim 9 wherein the face plate is provided with a central access portal of substantial size permitting the user to load or unload articles therethrough into the interior of the hollow assembled and locked door safe after removing it from the exterior door, without unlocking the locking means.

* * * * *